US008518295B2

(12) United States Patent
Carr et al.

(10) Patent No.: US 8,518,295 B2
(45) Date of Patent: Aug. 27, 2013

(54) LUBRICANTS FOR REFRIGERATION SYSTEMS

(75) Inventors: Dale Carr, Morristown, NJ (US); Jeffrey Hutter, Edison, NJ (US); Edward T. Hessell, Fairfield, CT (US); Richard Kelley, Princeton, NJ (US); Roberto Urrego, Newington, CT (US)

(73) Assignee: Chemtura Corporation, CT (US)

( * ) Notice: Subject to any disclaimer, the term of this patent is extended or adjusted under 35 U.S.C. 154(b) by 408 days.

(21) Appl. No.: 12/883,273

(22) Filed: Sep. 16, 2010

(65) Prior Publication Data

US 2011/0079749 A1 Apr. 7, 2011

Related U.S. Application Data

(60) Provisional application No. 61/249,338, filed on Oct. 7, 3009.

(51) Int. Cl.
*C09K 5/04* (2006.01)
*C10M 105/36* (2006.01)

(52) U.S. Cl.
USPC ..... 252/68; 508/496; 508/497; 560/180

(58) Field of Classification Search
USPC ..... 252/68; 508/496, 497; 560/180
See application file for complete search history.

(56) References Cited

U.S. PATENT DOCUMENTS

| | | | | |
|---|---|---|---|---|
| 5,096,606 | A | 3/1992 | Hagihara et al. | |
| 5,498,356 | A * | 3/1996 | Kamakura et al. | 508/495 |
| 5,551,524 | A | 9/1996 | Yamamoto et al. | |
| 5,853,609 | A | 12/1998 | Schnur et al. | |
| 6,221,272 | B1 | 4/2001 | Schnur et al. | |
| 2001/0038088 | A1 | 11/2001 | Schnur | |
| 2005/0049153 | A1 | 3/2005 | Zehler et al. | |

FOREIGN PATENT DOCUMENTS

| | | |
|---|---|---|
| WO | WO 93/01249 | 1/1993 |
| WO | WO 93/24585 | 12/1993 |

* cited by examiner

*Primary Examiner* — Douglas McGinty

(74) *Attorney, Agent, or Firm* — Joseph Suhadolnik; Chemtura Corporation

(57) ABSTRACT

A polyol ester suitable for use as a lubricant or a lubricant base stock has a kinematic viscosity at 40° C. greater than or equal to 200 cSt and a viscosity index of greater than or equal to 100. The ester comprises the reaction product of (a) a polyhydric alcohol component comprising at least 50 mole % of penterythritol, and (b) a carboxylic acid component comprising:

(i) at least one linear or branched monocarboxylic acid having 2 to 7 carbon atoms;

(ii) at least one branched monocarboxylic acid having 8 to 15 carbon atoms; and (iii) at least one polycarboxylic acid having 2 to 8 carbon atoms;

wherein the ratio of the number of acid groups derived from the monocarboxylic acid(s) (i) to the number of acid groups derived from the monocarboxylic acid(s) (ii) is between about 0.9 and about 1.1 and the number of acid groups derived from the polycarboxylic acid(s) (iii) is between about 15% and about 25% of the total number of acid groups derived from the carboxylic acids (i), (ii) and (iii).

12 Claims, 2 Drawing Sheets

LUBRICANTS FOR REFRIGERATION SYSTEMS

FIELD

This invention relates to polyol ester lubricants and their use in working fluids for refrigeration and air conditioning systems.

BACKGROUND

Polyol esters (POEs) are well known in the art as lubricants for displacement type refrigeration systems. Commonly used commercial POEs are derived from the reaction of a polyol (an alcohol containing 2 or more OH groups) with a monofunctional carboxylic acid. Such "simple" or "traditional" polyol esters are especially suited for use in systems utilizing hydrofluorocarbon refrigerants (HFCs) such as R-134a and related molecules because their polar nature provides improved miscibility with the refrigerant in comparison to other lubricants such as mineral oils, poly-alpha-olefins, or alkylated aromatics. One example of such a polyol ester lubricant is disclosed in U.S. Pat. No. 6,221,272.

The physical characteristics for simple polyol esters are primarily derived from the structure of the acid component. Because there are a wide variety of commercially available carboxylic acids, simple polyol esters can be designed with specific physical characteristics that are optimized for a particular refrigeration system application. But for simple polyol esters there are limits to the simultaneous optimization of all desired properties. For instance, the optimum lubricant would be one that has high miscibility with the refrigerant at low temperatures to ensure good transport of the lubricant in the evaporator and other low temperature components of the refrigeration cycle, but very low or poor solubility of the refrigerant in the lubricant at high temperature and pressure in the compressor to minimize viscosity reduction of the lubricant by refrigerant.

Viscosity reduction of the lubricant by refrigerant at high temperatures and pressures dramatically reduces the hydrodynamic lubricating ability of the lubricant. Also, the lubricity and load carrying ability of a polyol ester lubricant is improved by using longer chain linear acids rather than shorter chain and/or branched alkyl groups. But the exact opposite is true for miscibility with HFC or fluorocarbon refrigerants (i.e., branched and/or shorter chained acyl groups improve miscibility). So there is a careful balance required to optimize both the miscibility characteristics of the lubricant with refrigerant at low temperature and solubility of the refrigerant in the lubricant at high temperature and pressure, while also maintaining the best balance of lubricity and load carrying ability of the lubricant. In addition, the negative impact on lubricity and load carrying ability of the lubricant will become more pronounced as refrigeration system manufacturers move to lower viscosity lubricants to improve energy efficiency.

One mechanism for improving the lubricity and load carrying ability of a refrigeration lubricant is to include anti-wear/extreme pressure additives. However, such additives may be undesirable since they can either precipitate out from the lubricant at low temperatures (as are encountered in the evaporator) or decompose to insoluble by-products at very high temperatures (as are experienced in the compressor). Such "drop out" of the additives from the lubricant can often lead to deposits on, or complete blockage of, the refrigerant, system expansion device (thermal expansion valve, capillary, or needle valve) leading to a decrease in refrigeration performance or complete failure of the system. Additionally; for compressors with internal motors there is a potential for unfavorable reaction of the additives with the wire coatings used on the motors, leading to solubilization of the wire coatings in the system and eventual deposit on the expansion devise components.

Thus there is a need for a refrigeration lubricant that possesses high miscibility with the refrigerant over a wide temperature range of operation while also maintaining adequate lubricity and load carrying ability without the use of additives; provides protection against wear of refrigeration components and in addition improves the energy efficiency of the refrigeration system.

One potential way of addressing this need is to employ complex polyol esters, that is esters formed by the reaction of alcohols containing at least two —OH groups with polybasic carboxylic acids, normally in admixture with one or more monobasic carboxylic acids. Thus by virtue of their additional acid sites, polybasic acids offer the potential for tailoring the properties of the resultant esters to meet the varying requirements of an optimal lubricant.

For example, U.S. Pat. No. 5,096,606 discloses a refrigeration oil composition comprising (1) fluoroethane selected from the group consisting of 1,1,1,2-fluoroethane, pentafluoroethane, 1,1,1 trifluoroethane, and 1,1-difluoroethane and (2) an ester compound which is a reaction product obtained from (a) an aliphatic polyhydric alcohol having 1 to 6 primary hydroxyl groups, (b) a saturated aliphatic straight or branched monocarboxylic acid having 2 to 9 carbon atoms, or a derivative thereof and (c) a saturated aliphatic straight or branched dicarboxylic acid having 2 to 10 carbon atoms, or a derivative thereof, said ester compound having a kinematic viscosity at 100° C. of 1 to 100 cst.

In addition, U.S. Pat. No. 5,551,524 discloses a process for lubricating a vehicle air-conditioner initially containing refrigerant heat-transfer fluids made of molecules containing at least one chlorine atom per molecule and mineral oil lubricant dissolved therein wherein the refrigerant heat-transfer fluid and mineral oil lubricant have been replaced by a working fluid comprising a chlorine-free, fluoro-group-containing organic refrigerant heat-transfer fluid and lubricant or lubricant base stock, said process being characterized in that the lubricant or lubricant base stock is a liquid with a viscosity between about 45 and about 220 centistokes at 40° C., is miscible with 1,1,1,2-tetrafluoroethane to at least as low as −55° C. and consists essentially of a mixture of polyol ester molecules in which at least 92% of the alcohol moieties are derived from PE and at least 92% of the acyl groups are selected from the group consisting, of the acyl groups of all the straight and branched chain monobasic and dibasic carboxylic acids with from four to twelve carbon atoms each, said alcohol moieties and acyl groups being further selected subject to constraints that (a) a total of at least 5% of the acyl groups in the mixture are acyl groups of i-$C_5$ acid; (b) the ratio of the % of acyl groups in the mixture that contain eight or more carbon atoms and are unbranched to the % of acyl groups in the mixture that are both branched and contain not more than six carbon atoms is not greater than 1.56; (c) the % of acyl groups in the mixture that contain at least nine carbon atoms, whether branched or not, is not greater than 81; (d) not more than 2% of the acyl groups in the ester mixture are part of acid molecules with more than two carboxyl groups each; (e) a total of at least 20% of the acyl groups in the mixture are from $C_9$ and $C_8$ acids with at least two alkyl substituent branches per molecule of acid; and (f) at least 4.6% but not more than 13% of the acyl groups in the ester mixture are from adipic acid.

Further, U.S. Pat. No. 5,853,609 discloses a refrigerant working fluid which remains in a single phase between about −40° C. and about 71° C., said working fluid comprising a substantially chlorine-free fluoro-group-containing heat transfer fluid that comprises at least one of pentafluoroethane, 1,1-difluoroethane, 1,1,1-trifluoroethane and tetrafluoroethane and a composition of matter suitable for serving as a lubricant base stock, said composition being a liquid with a viscosity between about 22.5 and about 44 centistokes at 40° C. and consisting essentially of a mixture of polyol ester molecules in which at least 85% of the monobasic acid molecules in the acid mixture consist of molecules having five or nine carbon atoms each, at least about 92% of the alcohol moieties are selected from the group consisting of alcohol moieties derived from pentaerythritol (PE) and dipentaerythritol (DPE) and at least about 92% of the acyl groups are selected from the group consisting of the acyl groups of all the straight and branched chain monobasic and dibasic carboxylic acids with from four to twelve carbon atoms each, said alcohol moieties and acyl groups being further selected subject to the constraints that (a) a total of at least about 7% of the acyl groups in the mixture are acyl groups of i-$C_5$ acid; (b) the ratio of the percentage of acyl groups in the mixture that contain 8 or more carbon atoms and are unbranched to the percentage of acyl groups in the mixture that are both branched and contain not more than six carbon atoms is not greater than about 1.56; (c) the percentage of acyl groups in the mixture that contain at least nine carbon atoms, whether branched or not, is not greater than about 81; (d) not more than about 2% of the acyl groups in the ester mixture are part of acid molecules with more than two carboxyl groups each; (e) at least 60% of the monobasic acid molecules in the acid mixture consist of molecules having no more than ten carbon atoms each; and (f) a total of at least about 20% of the acid molecules in the mixture are one of the trimethylhexanoic acids; at least about 85% of the alcohol moieties in the esters are those of PE; and not more than about 7.5% of the acyl groups in the ester mixture are dibasic.

For some applications, particularly when employed in the working fluids of heavy duty industrial refrigeration and air conditioning systems, it is important that the polyol ester has a high kinematic viscosity, namely greater than 200 cSt at 40° C.

U.S. Published Patent Application No. 2005/0049153 discloses a high viscosity lubricant composition comprising a complex polyol ester having: (a) a polyfunctional alcohol residue; and (b) a saturated or unsaturated dicarboxylic acid residue having from about 9 to about 22 carbon atoms. All the complex polyol esters exemplified have a viscosity in excess of 200 cSt at 40° C. However, the long chain dicarboxylic acids required to achieve these high viscosity values have limited miscibility with many hydrofluorocarbon working fluids and so have limited potential for use as refrigerator lubricants.

A more common approach to the production of high viscosity complex polyol esters is to employ a polyol precursor with increased hydroxyl functionality, particularly dipentaerythritol (DiPE). However, DiPE is also expensive and its supply is highly dependent on the demand for monopentaerythritol (PE) since DiPE is a fractional by-product of PE manufacture. At certain times, the demand for PE drops and the supply of DiPE is very limited or non-existent. There is therefore a need to identify ways to reproduce the composition and performance of polyol esters normally derived from DiPE, including high viscosity esters, without having to use this expensive and possibly unavailable ingredient.

According to the present invention, it has now been found that a complex polyol ester with a kinematic viscosity greater than 200 cSt at 40° C., a high viscosity index and acceptable compatibility with hydrofluorocarbon refrigerants can be produced from PE as the polyol starting material using a particular combination of linear and branched monocarboxylic acids and short chain polycarboxylic acids.

SUMMARY

In one aspect, the invention resides in a polyol ester suitable for use as a lubricant or a lubricant base stock, the ester having a kinematic viscosity at 40° C. greater than or equal to 200 cSt and a viscosity index of greater than or equal to 100 and the ester comprising a reaction product of (a) a polyhydric alcohol component comprising at least 50 mole % of penterythritol, and (b) a carboxylic acid component comprising:

(i) at least one linear or branched monocarboxylic acid having 2 to 7 carbon atoms;

(ii) at least one branched monocarboxylic acid having 8 to 15 carbon atoms; and (iii) at least one polycarboxylic acid having 2 to 8 carbon atoms;

wherein the ratio of the number of acid groups derived from the monocarboxylic acid(s) (i) to the number of acid groups derived from the monocarboxylic acid(s) (ii) is between about 0.9 and about 1.1 and the number of acid groups derived from the polycarboxylic acid(s) (iii) is between about 15% and about 25% of the total number of acid groups derived from the carboxylic acids (i), (ii) and (iii).

Conveniently, the polyhydric alcohol component comprises at least 90 mole %, such as least 95 mole %, of penterythritol.

Conveniently, said at least one linear or branched monocarboxylic acid (i) has 5 to 7 carbon atoms and in one embodiment comprises i-pentanoic acid.

Conveniently, said at least one branched monocarboxylic acid (ii) has 8 to 12 carbon atoms and in one embodiment comprises i-nonanoic acid.

Conveniently, said at least one polycarboxylic acid (iii) has 4 to 7 carbon atoms and in one embodiment comprises adipic acid.

Conveniently, the ratio of the number of acid groups derived from the monocarboxylic acid(s) (i) to the number of acid groups derived from the monocarboxylic acid(s) (ii) is between about 0.9 and about 0.95, such as about 0.93.

Conveniently, the number of acid groups derived from the polycarboxylic acid(s) (iii) is between about 19% and about 21% of the total number of acid groups derived from the carboxylic acids (i), (ii) and (iii).

In a further aspect, the invention resides in a working fluid comprising a halogenated hydrocarbon refrigerant and a polyol ester as described herein.

DESCRIPTION OF THE EMBODIMENTS

Figure 1:
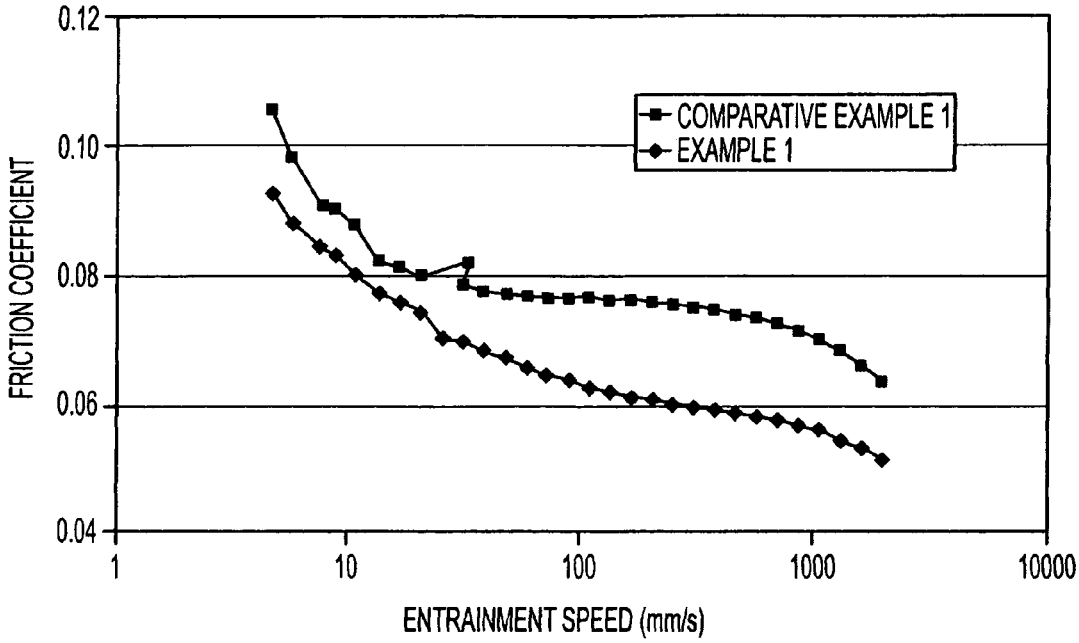
FIG. 1 is a graph of friction coefficient as a function of increasing entrainment speed at a temperature of 80° C. and a load of 30N for the lubricants of Example 1 and Comparative Example 1 when tested in the Mini-Traction Machine Test as described in Example 2.

Described herein is a polyol ester having a kinematic viscosity at 40° C. greater than or equal to 200 cSt and a viscosity index of greater than or equal to 100. Typically the polyol ester has a kinematic viscosity of about 220 cSt at 40° C. and about 20 at 100° C. and a viscosity index of about 100 to about 110. The polyol ester also has a broad miscibility range in hydrofluorocarbon refrigerants, such as R-134a, making it desirable for use as a lubricant or lubricant base stock in the working fluids of heavy duty industrial refrigeration and air conditioning systems.

The present polyol ester comprises a reaction product of (a) a polyhydric alcohol component comprising at least 50 mole %, typically at least 90 mole %, such as least 95 mole %, even 100 mole %, of penterythritol and (b) a mixture of carboxylic acids comprising:

(i) at least one linear or branched monocarboxylic acid having 2 to 7 carbon atoms;

(ii) at least one branched monocarboxylic acid having 8 to 15 carbon atoms; and (iii) at least one polycarboxylic acid having 2 to 8 carbon atoms.

The at least one linear or, branched monocarboxylic acid (i) generally has 5 to 7 carbon atoms and is conveniently selected from n-pentanoic acid, i-pentanoic acid, n-hexanoic acid, i-hexanoic acid, n-heptanoic acid and i-heptanoic acid. In one practical embodiment, the at least one linear or branched monocarboxylic acid (i) comprises i-pentanoic acid.

The at least one branched monocarboxylic acid (ii) generally has 8 to 12 carbon atoms and in said one practical embodiment comprises i-nonanoic acid (3,5,5-trimethylhexanoic acid).

The ratio of the number of acid groups derived from the monocarboxylic acid(s) (i) in the mixture of carboxylic acids (b) to the number of acid groups derived from the monocarboxylic acid(s) (ii) in said mixture is between about 0.9 and about 1.1, and typically is between about 0.9 and about 0.95, such as about 0.93.

The at least one polycarboxylic acid (iii) generally has 4 to 7 carbon atoms and in said one practical embodiment comprises adipic acid.

The number of acid groups derived from the polycarboxylic acid(s) (iii) is between about 15% and about 25%, typically between about 19% and about 21%, of the total number of acid groups in the mixture of carboxylic acids (b).

The present polyol ester can be produced in a single step or by a two stage reaction.

In the single step process, the total amounts of the polyol, polybasic acid and monobasic acid or acid mixture are charged to the reaction vessel at the beginning of the reaction, with the relative amount of polyol to acids in the charge being adjusted to provide a total hydroxyl:carboxylic molar equivalent ratio of about 0.9 to about 1.3, preferably about 0.95 to about 1.15 and more preferably about 1.0 to about 1.1.

In the two step process, the polyhydric alcohol (charged so as to provide 1.0 molar equivalents of hydroxyl) is charged to a reaction vessel in the first step along with an acid charge that includes the total amount of the desired polycarboxylic acid and a portion of the monocarboxylic acid so as to provide a total of about 0.8 to about 0.9 molar equivalents of acid, such as about 0.87 molar equivalents of acid. Using an undercharge of monocarboxylic acid in the first step helps to ensure that all of the dicarboxylic acid is esterified. The charge is then heated to the final reaction temperature and the first reaction step is continued until the acid value of the charge is less than 5, most preferably less than 1. Once the acid value target from the first step is attained, the remainder of the monocarboxylic acid(s) is charged to the reaction vessel to bring the combined molar equivalents of acid from both the dibasic and monobasic acids to a value of about 0.9 to about 13, preferably about 0.95 to about 1.15 and more preferably about 1.0 to about 1.1.

Whether conducted in one or two steps, the reaction is generally effected in a reaction vessel equipped with a mechanical stirrer, Dean-Stark trap and vertical water cooled condensor, thermocouple/heating mantle/temperature controller and nitrogen purge. Optionally, a catalyst, such as stannous oxalate is added to the reaction mixture. The charge is heated to a final reaction temperature of 220 to 260° C. under a slight purge of nitrogen during which the water of reaction is collected in the Dean-Stark trap and the acid is returned to the reactor. Any excess acid is finally stripped from the reaction mixture at reduced pressure to a hydroxyl value of less than 10 and an acid value <0.10

The resultant ester may be used without further purification or may be further purified using conventional techniques such as distillation, treatment with acid scavengers to remove trace acidity, treatment with moisture scavengers to remove moisture and/or filtration to improve clarity.

The present polyol esters are particularly intended for use as lubricants in working fluids for refrigeration and air conditioning systems, wherein the ester is combined with a heat transfer fluid, generally fluoro-containing organic compound such as a hydrofluorocarbon or fluorocarbon; a mixture of two or more hydrofluorocarbons or fluorocarbons; or any of the preceding in combination with a hydrocarbon. Non-limiting examples of suitable fluorocarbon and hydrofluorocarbon compounds include carbon tetrafluoride (R-14), difluoromethane (R-32), 1,1,1,2-tetrafluoroethane (R-134a), 1,1,2,2-tetrafluoroethane (R-134), pentafluoroethane (R-125), 1,1,1-trifluoroethane (R-143a) and tetrafluoropropene (R-1234yf). Non-limiting examples of mixtures of hydrofluorocarbons, fluorocarbons, and/or hydrocarbons include R-404A (a mixture of 1,1,1-trifluoroethane, 1,1,1,2-tetrafluoroethane and pentafluoroethane), R-410A (a mixture of 50 wt % difluoromethane and 50 wt % pentafluoroethane), R-410B (a mixture of 45 wt % difluoromethane and 55 wt % pentafluoroethane), R-417A (a mixture of 1,1,1,2-tetrafluoroethane, pentafluoroethane and n-butane), R-422D (a mixture of 1,1,1,2-tetrafluoroethane, pentafluoroethane and iso-butane), R-427A (a mixture of difluoromethane, pentafluoroethane, 1,1,1-trifluoroethane and 1,1,1,2-tetrafluoroethane) and R-507 (a mixture of pentafluoroethane and 1,1,1-trifluoroethane).

The present polyol esters can also be used with non-HFC refrigerants such as R-22 (chlorodifluoromethane), dimethylether, hydrocarbon refrigerants such as iso-butane, carbon dioxide and ammonia. A comprehensive list of other useful refrigerants can be found in European Published Patent Application EP 1985681 A, which is incorporated by reference in its entirety.

A working fluid containing the polyol ester described above as the base oil may further contain mineral oils and/or synthetic oils such as poly-α-olefins, alkylbenzenes, esters other than those described above, polyethers, polyvinyl ethers, perfluoropolyethers, phosphoric acid esters and/or mixtures thereof.

In addition, it is possible to add to the working fluid conventional lubricant additives, such as antioxidants, extreme-pressure additives, antiwear additives, friction reducing additives, defoaming agents, profoaming agents, metal deactivators, acid scavengers and the like.

Examples of the antioxidants that can be used include phenolic antioxidants such as 2,6-di-t-butyl-4-methylphenol and 4,4'-methylenebis(2,6-di-t-butylphenol); amine antioxidants such as p,p-dioctylphenylamine, monooctyldiphenylamine, phenothiazine, 3,7-dioctylphenothiazine, phenyl-1-naphthylamine, phenyl-2-naphthylamine, alkylphenyl-1-naphthylamine, and alkylphenyl-2-naphthylamine; sulfur-containing antioxidants such as alkyl disulfide, thiodipropionic acid esters and benzothiazole; and zinc dialkyl dithiophosphate and zinc diaryl dithiophosphate.

Examples of the extreme-pressure additives, antiwear additives, friction reducing additives that can be used include zinc compounds such as zinc dialkyl dithiophosphate and zinc diaryl dithiophosphate; sulfur compounds such as thiodipropinoic acid esters, dialkyl sulfide, dibenzyl sulfide, dialkyl polysulfide, alkyl mercaptan, dibenzothiophene and 2,2'-dithiobis(benzethiazole); sulfur/nitrogen ashless antiwear additives such as dialkyldimercaptothiadiazoles and methylenebis(N,N-dialkyldithiocarbamates); phosphorus compounds such as triaryl phosphates such as tricresyl phosphate and trialkyl phosphates; dialkyl or diaryl phosphates; trialkyl or triaryl phosphites; amine salts of alkyl and dialkylphosphoric acid esters such as the dodecylamine salt of dimethylphosphoric acid ester; dialkyl or diaryl phosphites; monoalkyl or monoaryl phosphites; fluorine compounds such as perfluoroalkyl polyethers, trifluorochloroethylene, polymers and graphite fluoride; silicon compounds such as a fatty acid-modified silicone; molybdenum disulfide, graphite, and the like. Examples of organic friction modifiers include long chain fatty amines and glycerol esters.

Examples of the defoaming and profoaming agents that can be used include silicone oils such as dimethylpolysiloxane and organosilicates such as diethyl silicate. Examples of the metal deactivators that can be used include benzotriazole, tolyltriazole, alizarin, quinizarin and mercaptobenzothiazole. Furthermore, epoxy compounds such as phenyl glycidyl ethers, alkyl glycidyl ethers, alkylglycidyl esters, epoxystearic acid esters and epoxidized vegetable oil, organotin compounds and boron compounds may be added as acid scavengers or stabilizers.

Examples of moisture scavengers include trialkylorthoformates such as trimethylorthoformate and triethylorthoformate, ketals such as 1,3-dioxacyclopentane, and amino ketals such as 2,2-dialkyloxazolidines.

The working fluids comprising the esters of the invention and a refrigerant can be used in a wide variety of refrigeration and heat energy transfer applications, but are particularly intended for use in industrial air-conditioning units for factories, office buildings, apartment buildings and warehouses and for large scale refrigeration units for warehouses and ice skating rinks.

Types of compressors useful for the above applications can be classified into two broad categories; positive displacement and dynamic compressors. Positive displacement compressors increase refrigerant vapor pressure by reducing the volume of the compression chamber through work applied to the compressor's mechanism. Positive displacement compressors include many styles of compressors currently in use, such as reciprocating, rotary (rolling piston, rotary vane, single screw, twin screw), and orbital (scroll or trochoidal). Dynamic compressors increase refrigerant vapor pressure by continuous transfer of kinetic energy from the rotating member to the vapor, followed by conversion of this energy into a pressure rise. Centrifugal compressors function based on these principles. Details of the design and function of these compressors for refrigeration applications can be found in the 2008 ASHRAE Handbook, HVAC systems and Equipment, Chapter 37; the contents of which are included in its entirety by reference.

The invention will now be more particularly described with reference to the following non-limiting Examples and the accompanying drawings.

EXAMPLE 1

Monopentaerythritol (136.2 grams, 1.0 moles; 4.0 molar equivalent of hydroxyl) was charged to a round bottom flask equipped with a mechanical stirrer, Dean-Stark trap and vertical water cooled condensor, thermocouple/heating mantle/temperature controller and nitrogen purge along with 156.3 grams (1.53 moles) of iso-pentanoic acid, 2.6 grams (0.02 moles) of n-heptanoic acid, 261.1 grams (1.65 moles) of iso-nonanoic acid (3,5,5-trimethylhexanoic acid), 58.5 grams (0.40 moles, 0.8 equivalents of H+) of adipic acid and 0.2 grams tin oxalate catalyst. Thus, with regard to the acid components of the reaction mixture, 38.25 mole % of acid groups were derived from iso-pentanoic acid, 0.5 mole % from heptanoic acid, 41.25% from iso-nonanoic acid and 20 mole % of acid groups were derived from adipic acid.

The charge was heated to a final reaction temperature of between about 227° C. and 232° C. The water of reaction was collected in the Dean-Stark trap while any distilled acids were returned to the reactor. Vacuum was applied as needed in order to maintain the reaction. When the hydroxyl value was reduced to a sufficiently low level (a maximum of 5.0 mg KOH/gm) the excess acid was removed by vacuum distillation. The residual acidity was neutralized with an acid scavenger. The resulting ester base stock was dried under nitrogen purge and filtered. The properties of the filtered base stock are summarized in Table 1, from which it will be seen that the ester base stock had a kinematic viscosity at 40° C. of 204.3 cSt with a viscosity index of 108.

COMPARATIVE EXAMPLE 1

Comparative Example 1 is a commercial ISO 220 polyol ester available under the trade name Hatco 331.6 from Chemtura Corporation. It is derived from the reaction of dipentaerythritol with a mixture of n-pentanoic acid and iso-nonanoic acid. The properties of the commercial product are also summarized in Table 1.

As can be seen from the data presented in Table 1, the lubricant of Example 1 has a higher viscosity index and lower pour point than the lubricant, of Comparative Example 1 while still possessing good miscibility (defined here as being miscible with R-134a at 10 volume-percent lubricant to <−20° C.).

TABLE 1

| Property | Test Method | Example 1 | Comparative Example 1 |
|---|---|---|---|
| ISO Viscosity Grade | ASTM 2422 | 220 | 220 |
| Kinematic Viscosity, 40° C. (cSt) | ASTM D445 | 214 | 240 |
| Kinematic Viscosity, 100° C. (cSt) | ASTM D445 | 20 | 20 |
| Viscosity Index (typical) | ASTM D2270-93 | 108 | 95 |
| Density at 20° C. (gm/ml) | ASTM D1298 | 1.013 | 0.982 |
| Pour Point, (° F. or ° C.?) | ASTMD97-97a (auto) | −33 | −29 |
| Flash Point, COC, (° F. or ° C.?) | ASTM-92 | 268 | 285 |
| Moisture (ppm) | ASTM D1533 | 25 | 25 |
| Total Acid Number (mg KOH/g) | ASTM D974-95 | 0.08 | 0.02 |
| ASTM Color | ASTM D1500-96 | <0.5 | <0.5 |
| Miscibility Range in R-134a at 10 vol % (° F. or ° C.?) | | −24 to +51 | −29 to +70 |
| Copper Corrosion Test, 3 hr at 100° C. | ASTM D130 | 1A | 1A |
| Dielectric Constant, 25° C. (kV) | ASTM D877 | >42 | >42 |
| Sealed Tube Stability with Copper and Steel | ASHRAE 97 | | |
| Delta TAN (mg KOH/gm) | | 0.1.1 | 0.12 |
| Oil and R-134a | | <0.01% | <0.01% |
| Hydroxyl Number (mg KOH/gm) | ASTM D1957 | 6 | 1 |
| Hydrolytic Stability: TAN (mg KOH/gm) | | 0.3 | 0.3 |
| Falex Pin/Vee Block, Load to Failure (direct load, lb.) (AISI 3135 Steel Pin and AISI C-1137 V-Block) | ASTM d-3233-93 Method A | 750 | 750 |
| Miscibility in R-134a (° C.) | | | |
| 5 volume % | | −23 to +44 | −47 to +66 |
| 10 volume % | | −24 to +51 | −29 to >+70 |
| 30 volume % | | −38 to +67 | −17 to >+70 |
| 60 volume % | | <−60 to >+70 | <−60 to >+70 |
| Decomposition, ° C. | | 214 | 203 |

COMPARATIVE EXAMPLES 2 TO 11

The process of Example 1 was repeated with the different mixtures of polyols, $C_5$ to $C_9$ monocarboxylic acids and adipic acid summarized in Tables 2 and 3. The physical properties of the resultant filtered base stocks are also summarized in Table 2.

From Table 2, it will be seen that the products of Comparative Examples 1 and 2 are produced from dipentaerythritol (DiPE) using monoacid combinations of valeric/iso-nonanoic or iso-pentanoic/n-heptanoic/iso-nonanoic, respectively. The products have low temperature miscibility limits in R-134a of <−20° C. but have low viscosity index.

From Table 2, it will also be seen that the products of Comparative Examples 3-6 are prepared using either pure monopentaerythritol or technical grade pentaerythritol (containing 10 wt % of dipentaerythritol) with monoacid mixtures of valeric/iso-nonanoic and adipic acid as the diacid. The products have either a kinematic viscosity at 40° C. of less than 200 cSt, a low temperature miscibility limit in R-134a of >−20° C., or both.

Comparative Examples 7-11 are examples of products that use the same raw materials as Example 1 but, as shown in Table 3, in relative amounts that do not provide both a kinematic viscosity at 40° C. of at least 200 cSt and a low temperature miscibility limit of <−20° C. at 10 volume percent lubricant in R-134a.

TABLE 2

| Example No | 1 | Comp. 1 | Comp. 2 | Comp. 3 | Comp. 4 | Comp. 5 | Comp. 6 |
|---|---|---|---|---|---|---|---|
| Polyol(s) (mole equivalent OH) | | | | | | | |
| Mono-PE | 100 | | 32.2 | | | 100 | 100 |
| Tech-PE | | | | 100 | 100 | | |
| DiPE | | 100 | 67.8 | | | | |
| Acids (mole equivalent H+) | | | | | | | |
| Iso-C5 | 38.25 | | 7.46 | | | | |
| n-C5 | | 28.91 | | 23.67 | 20 | 23.09 | 24.23 |
| n-C7 | 0.5 | | 0.51 | | | | |
| Iso-C9 | 41.25 | 71.08 | 92.03 | 58.30 | 66 | 56.88 | 59.75 |
| Adipic acid | 20 | | | 18.00 | 14 | 20.03 | 16.02 |
| Physical Properties | | | | | | | |
| Kinematic Viscosity, 40° C. (cSt) | 214 | 240 | 224 | 254 | 177 | 204.4 | 160 |
| Kinematic Viscosity, 100° C. (cSt) | 20 | 20 | 18 | 22.4 | 16.6 | 18.7 | |
| Viscosity Index | 108 | 95 | 86 | 107 | 98 | 102 | |
| Miscibility Limit in R134a at 10 vol % (° C.) | −24 | −29 | −21 | +12 | −20 | −11 | N/A |

TABLE 3

| Example No | Comp. 7 | Comp. 8 | Comp. 9 | Comp. 10 | Comp. 11 |
|---|---|---|---|---|---|
| Polyol(s) (mole equivalent OH) | | | | | |
| Mono-PE | 100 | 100 | 100 | 100 | 100 |
| Tech-PE | | | | | |
| DiPE | | | | | |
| Acids (mole equivalent H+) | | | | | |
| Iso-C5 | 23.09 | 36.50 | 19.00 | 40.00 | 73.50 |
| n-C5 | | | | | |
| n-C7 | 0.50 | | | | |
| Iso-C9 | 56.38 | 40.00 | 65.00 | 43.50 | 1.00 |
| Adipic acid | 20.00 | 23.00 | 16.00 | 16.00 | 25.00 |
| Physical Properties | | | | | |
| Kinematic Viscosity, 40° C. (cSt) | 289 | 274.8 | 224 | 150.7 | 169.2 |
| Kinematic Viscosity, 100° C. (cSt) | | 24 | 19.2 | | |
| Viscosity Index | | 110 | 98 | | |
| Miscibility Limit in R134a at 10 vol % (° C.) | +12 | −1 | −12 | −37 | <−60 |

EXAMPLE 2

Lubricity Testing

The lubricity of the lubricants of Example 1 and Comparative Example 1 was evaluated using a mini-traction machine (MTM) commercially available from PCS Instruments. This test measures the lubricity/frictional properties of lubricants by two different techniques using a rotating ball-on-disk geometry.

In the first mode of operation, the lubricity of the lubricant is measured under full fluid film conditions (hydrodynamic lubrication). The speed of the ball and disk are ramped simultaneously at a slide-roll ratio of 50% and the coefficient of friction is measured as a function of entrainment speed at constant load and temperature (Stribeck Curve). This means that the ball is always moving at 50% of the speed of the rotating disk as the speed of the disk is ramped. As the speed of the disk and ball are increased there is a pressure build up at the front of the rolling/sliding contact due to the movement of the lubricant to either side of the metal-metal contact. At some point the speed becomes fast enough and the pressure becomes sufficient to result in lubricant entrainment between the ball and the disk contact. At this point the system is under hydrodynamic lubrication; meaning that the lubrication is controlled by the integrity of the film between the ball and disk. A lower coefficient of friction at high entrainment speeds indicates a lubricant with better lubricity performance.

In the second mode of operation, the lubricity is measured over the total range of lubrication regimes (boundary, mixed film, elastrohydrodynamic and hydrodynamic). In this test, the coefficient of friction is measured at constant load and temperature at various slide/roll ratios (i.e., the ball and disk are rotated at different speeds relative to one another)(Traction Curve).

For both modes of operation the test is typically conducted at several different fixed temperatures; in this case 80, 120 and 135° C. and a load of 30 N. Coefficient of friction is a direct measurement of the lubricity of the lubricant; the lower the coefficient of friction, the higher the lubricity of the lubricant. It is important to note that for this test it is only meaningful to compare lubricants of equivalent ISO viscosity grade. The results are given in FIGS. 1 to 4.

Figure 2:
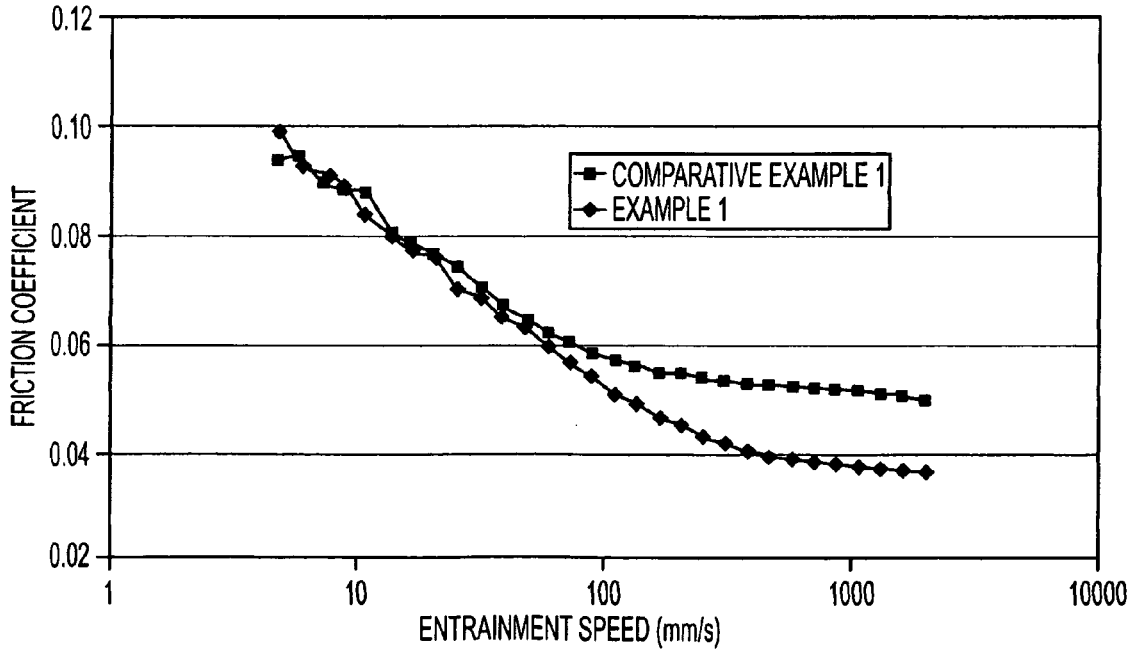
FIG. 2 is a graph of friction coefficient as a function of increasing entrainment speed at a temperature of 120° C. and a load of 30N for the lubricants of Example 1 and Comparative Example 1 when tested in the Mini-Traction Machine Test as described in Example 2.
Figure 3:
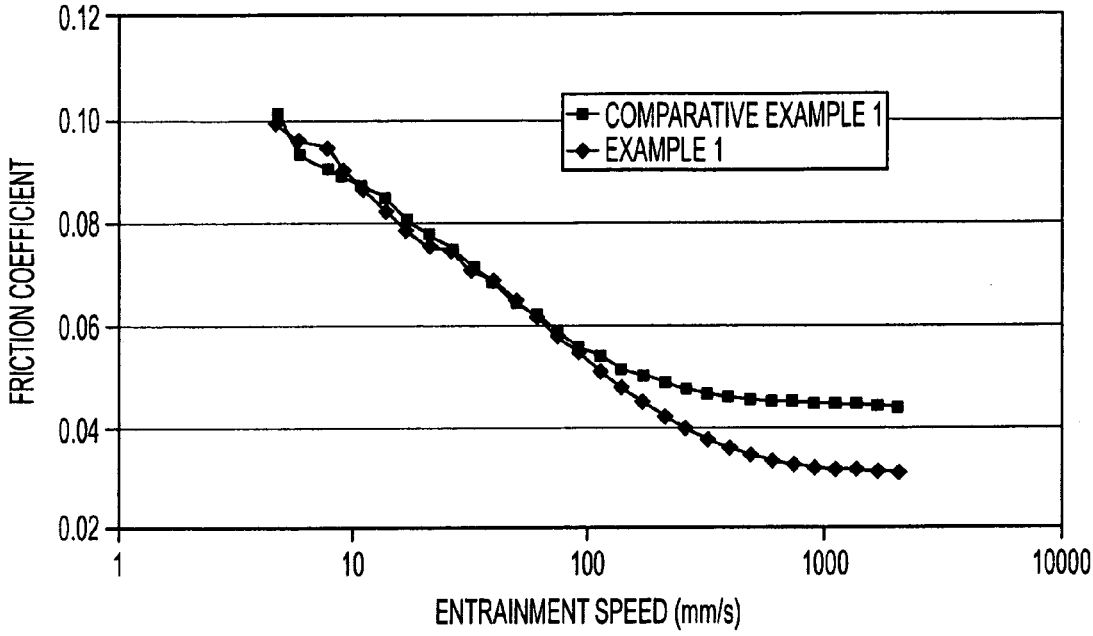
FIG. 3 is a graph of friction coefficient as a function of increasing entrainment speed at a temperature of 120° C. and a load of 30N for the lubricants of Example 1 and Comparative Example 1 when tested in the Mini-Traction Machine Test as described in Example 2.
Figure 4:
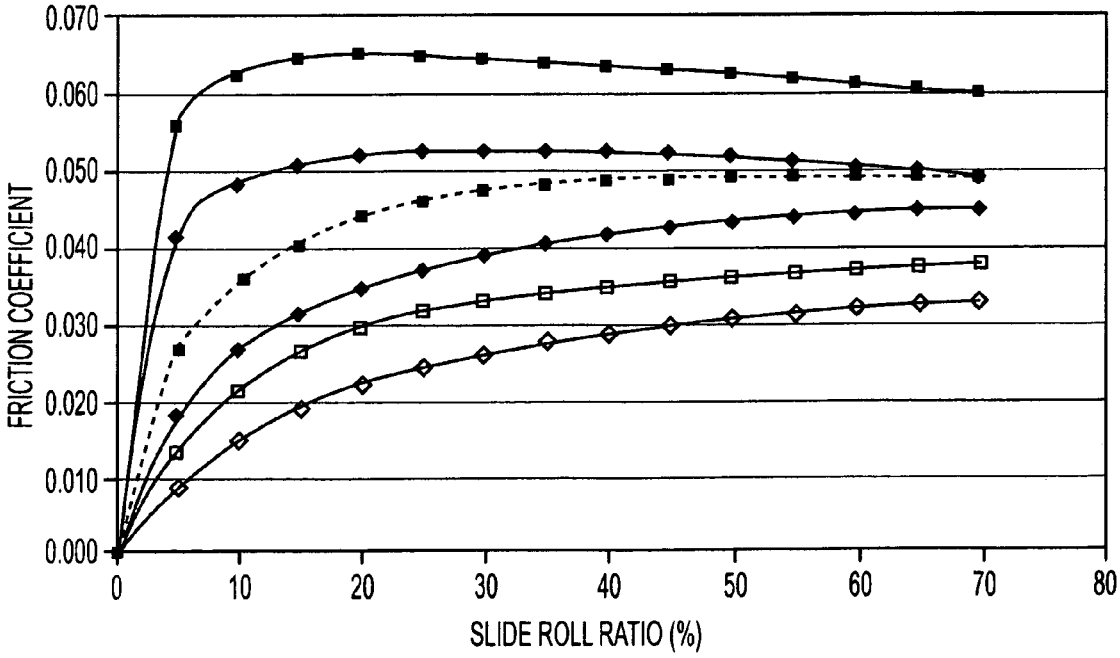
FIG. 4 is a graph of friction coefficient against slide to roll ratio at a temperatures of 80° C., 120° C. and 135° C. and a load of 30N for the lubricants of Example 1 and Comparative Example 1 when tested in the Mini-Traction Machine Test as described in Example 2.

The Stribeck curve measurements at 80° C., 120° C. and 135° C. shown in FIGS. 1 to 3 demonstrate that the coefficient of friction is always lower for the lubricant of the invention as compared to that the comparative lubricant. The traction coefficient results shown in FIG. 4 demonstrate that the friction is always lower for the lubricant of the invention (Example 1) as compared to that of Comparative Example 1 at a given temperature.

While the present invention has been described and illustrated by reference to particular embodiments, those of ordinary skill in the art will appreciate that the invention lends itself to variations not necessarily illustrated herein. For this reason, then, reference should be made solely to the appended claims for purposes of determining the true scope of the present invention.

The invention claimed is:

1. A polyol ester suitable for use as a lubricant or a lubricant base stock, the ester having a kinematic viscosity at 40° C. greater than or equal to 200 cSt and a viscosity index of greater than or equal to 100 and the ester comprising a reaction product of (a) a polyhydric alcohol component comprising at least 90 mole % of penterythritol, and (b) a carboxylic acid component comprising:

(i) at least one linear or branched monocarboxylic acid having 5 to 7 carbon atoms;

(ii) at least one branched monocarboxylic acid having 8 to 12 carbon atoms; and (iii) at least one polycarboxylic acid having 2 to 8 carbon atoms;

wherein the ratio of the number of acid groups derived from the monocarboxylic acid(s) (i) to the number of acid groups derived from the monocarboxylic acid(s) (ii) is between about 0.9 and about 1.1 and the number of acid groups derived from the polycarboxylic acid(s) (iii) is between about 15% and about 25% of the total number of acid groups derived from the carboxylic acids (i), (ii) and (iii).

2. The ester of claim 1, wherein the polyhydric alcohol component comprises at least 95 mole % of penterythritol.

3. The ester of claim 1, wherein said at least one linear or branched monocarboxylic acid (i) is selected from n-pentanoic acid, i-pentanoic acid, n-hexanoic acid, i-hexanoic acid, n-heptanoic acid and i-heptanoic acid.

4. The ester of claim 1, wherein said at least one branched monocarboxylic acid (ii) comprises i-nonanoic acid (3,5,5-trimethylhexanoic acid).

5. The ester of claim 1, wherein said at least one polycarboxylic acid (iii) has 4 to 7 carbon atoms.

6. The ester of claim 1, wherein said at least polycarboxylic acid (iii) comprises adipic acid.

7. The ester of claim 1, wherein the ratio of the number of acid groups derived from the monocarboxylic acid(s) (i) to the number of acid groups derived from the monocarboxylic acid(s) (ii) is between about 0.9 and about 0.95.

8. The ester of claim 1, wherein the ratio of the number of acid groups derived from the monocarboxylic acid(s) (i) to the number of acid groups derived from the monocarboxylic acid(s) (ii) is about 0.93.

9. The ester of claim 1, wherein the number of acid groups derived from the polycarboxylic acid(s) (iii) is between about 19% and about 21% of the total number of acid groups derived from the carboxylic acids (i), (ii) and (iii).

10. A lubricant blend comprising a mixture of the polyol ester of claim 1 and a further polyol ester having a different kinematic viscosity than said first mentioned polyol ester.

11. A working fluid comprising a halogenated hydrocarbon refrigerant and the polyol ester of claim 1.

12. The working fluid of claim 11 wherein the refrigerant is a hydrofluorocarbon, a fluorocarbon or a mixture thereof.

* * * * *